US006074185A

United States Patent [19]

Protos

[11] Patent Number: 6,074,185

[45] Date of Patent: Jun. 13, 2000

[54] SCROLL COMPRESSOR WITH IMPROVED TIP SEAL

[75] Inventor: Paul Thomas Protos, Dayton, Ohio

[73] Assignee: General Motors Corporation, Detroit, Mich.

[21] Appl. No.: 09/200,565

[22] Filed: Nov. 27, 1998

[51] Int. Cl.[7] ..... F01C 1/02

[52] U.S. Cl. ..... 418/55.4; 418/55.2; 418/142

[58] Field of Search ..... 418/55.4, 55.2, 418/142

[56] References Cited

U.S. PATENT DOCUMENTS

| | | | |
|---|---|---|---|
| 4,199,308 | 4/1980 | McCullough . | |
| 4,453,899 | 6/1984 | Hiraga et al. . | |
| 4,462,771 | 7/1984 | Teegarden | 418/55 |
| 4,666,380 | 5/1987 | Hirano et al. . | |
| 4,696,084 | 9/1987 | Hirano et al. . | |
| 4,722,676 | 2/1988 | Sugimoto | 418/55 |
| 4,869,658 | 9/1989 | Tsutsumi et al. . | |
| 5,364,247 | 11/1994 | Fukanuma et al. . | |
| 5,584,677 | 12/1996 | Ishikawa et al. | 418/55.2 |

*Primary Examiner*—Thomas Denion
*Assistant Examiner*—Theresa Trien
*Attorney, Agent, or Firm*—Patrick M. Griffin

[57] ABSTRACT

A scroll wall tip seal of novel shape allows the scroll wall to be machined with a single, larger concave transition corner radius, where the flank of the scroll wall blends into the scroll base plate. The tip seal covers the entire surface area of the terminal edge of the scroll wall, and has convex radiused sides that match the single radius of the scroll wall's concave transition corner. This allows the scroll wall to be machined with a single tool, all the way round, in a single pass.

3 Claims, 4 Drawing Sheets

SCROLL COMPRESSOR WITH IMPROVED TIP SEAL

TECHNICAL FIELD

This invention relates to scroll compressors in general, and specifically to a scroll compressor with a novel tip seal that allows for a simplified scroll machining process.

BACKGROUND OF THE INVENTION

Scroll compressors comprise a pair of scrolls, a fixed scroll and an orbiting scroll. The two scrolls are nested or interengaged within the compressor in an opposed orientation, that is, with the spiral scroll wall flanks facing in opposite directions. The flanks of the scroll walls engage at rolling contact lines which form gas pockets that continually expand and contract in toward the center to compress refrigerant vapor. The gas pockets are sealed both by the close engagement of the rolling contact lines and by the axial engagement of the terminal edges of each scroll wall with an opposed flat surface of the other scroll. The axial end sealing of the pockets is assisted by tip seals inset into grooves in the terminal edges of the scroll walls.

A typical orbiting scroll is shown in FIGS. 1 through 4, and indicated generally at 10. The non-illustrated fixed scroll is essentially identically configured, at least in those aspects relevant to the subject invention. A base plate 12 has a flat sealing surface 14 from which a scroll or involute wall 16 extends to a terminal edge 18. As can be clearly seen, the edge 18 is much thicker at the inboard end (T1) than at the outboard end (T2), due to the fact that the gas pocket pressure, which acts in the direction of the arrows, is much greater at that point than further outboard. Each scroll's terminal edge 18 carries a spiral shaped tip seal 20 that is inserted nearly flush into the surface of the edge 18. Very little of the original surface of edge 18 remains to either side of seal 20, so it is not feasible to machine the corners of edge 18 with anything but a very small, sharp radius, with one exception noted below.

Referring specifically to FIG. 2, seal 20, in modern designs, is typically an injection molded plastic material with superior lubricity, such as the commercially available high temperature plastic PPS. It has a width slightly less than the width of its mounting groove, and a thickness slightly less than the depth thereof. The conventional tip seal 20 is square cornered in cross section, and does not run all the way to either end of the edge 18, since the mounting groove therefore cannot run all the way to the end. For the same reason, the tip seal 20 is obviously narrower than the edge 18 throughout, since the mounting groove must be narrower.

Referring next to FIG. 4, further details of the scroll 10 are illustrated. The surfaces of the scroll wall 16 and the sealing surface 14 must obviously be carefully machined to shape in order to assure tight sealing of the gas pockets, and adequate compression. The machining and shape of the transition between the flank surface of the scroll wall 16 and the base plate flat surface 14 is also critical to proper operation. That transition, rather than being truly sharp cornered, has a slight concave curvature that is generally referred to as a fillet radius. Basic mechanics teaches that a too sharp fillet radius can create a stress riser and potential cracking. Since the higher pressure in the gas pocket toward the inboard end of the scroll wall 16 puts the fillet radius there in greater tension, a larger fillet radius R2 of approximately 1 mm is used over the length thereof so marked. The rest of the fillet radius around both sides of the scroll wall 16 is sharper, with a concave radius of approximately 0.2 mm. The machining sequence is as follows. First, an end mill with the larger, R2 radius is run around the entire length of the transition of the flank or scroll wall 16 to the surface 14 on both sides thereof. The larger radius R2 would interfere with the sharp cornered terminal edge 18 of the opposed scroll, however. In order to allow proper matching of terminal edge to transition, a second end mill with the sharper, R1 radius is next run around almost the entire length of the transition again, cutting material out of it and leaving the sharper radius R1 behind. The second tool is pulled radially out and away from the inboard side of the transition before reaching the inboard end, however. As seen in FIG. 4, this leaves a distinctive "stepped" section at B, with the remainder of the corner up to the thicker inboard end retaining the original, larger radius R2. Finally above that length of the transition corner that has either the larger radius R2 or the "step", a corresponding length of the otherwise sharp cornered edge 18 is chamfered off at C, with yet a third tool. The length C is the only non sharp corner on the edge 18, and it can be successfully cut, since the edge 18 is wider at that point.

Referring next to FIG. 8, the operation of a conventional pair of scrolls is illustrated Corresponding surfaces of the other, fixed scroll are given the same number primed. Gas pocket pressure is able to leak slightly under the seal 20, which is biased out slightly proud of the surface of the edge 18 to tightly engage the opposed flat sealing surface 14. The degree of clearance around the seal 20 is exaggerated for purposes of illustration. Sealing is assisted, and direct metal to metal contact with the flat surfaces 14–14' is avoided. This is only true where the seals 20–20' are disposed, however, and they do not run end to end of the edges 18–18'. The convex corners of the edges 18–18' do directly face the concave transition corners of scroll wall 16 (16') to surface 14 (14') at all points, metal to metal. This is so, because the seals 20–20' do run the full width of the edges 18–18', and cannot. since they are inset into a groove. Those convex corners must be given a radius that is equal to or greater than the concave corner so as to avoid the possibility of metal to metal interference contact. And since the convex corner of edge 18 is machined out of very narrow border of metal remaining after the mounting groove is cut, it must have a small, sharp radius, as must the matching concave transition corner. While this common configuration has worked well in practice, the need for three different tools and three different operations to produce the two radii, R1 and R2, plus the chamfer C, adds time and expense. There is no obvious way to eliminate the three total steps, however, since the inboard end of the scroll wall needs the larger radius, but that larger radius cannot be applied all the way around.

SUMMARY OF THE INVENTION

The invention provides a novel tip seal design that does allow the entire scroll wall transition to be machined with a single tool and a single, larger radius in the concave transition corner.

In the preferred embodiment disclosed, the tip seal covers the entire width of the scroll wall terminal edge, corner to corner and end to end. A base portion of the seal still fits into a narrow groove in the scroll wall edge, but the sides of the seal run flush to the otherwise sharp corners of the scroll wall terminal edge. In addition, both sides of the seal are formed with a single convex radius over their entire length.

The scroll wall has a single, concave transition corner radius, as large as the larger radius found in the prior art scroll, which extends all the way around. The scroll wall can therefore be machined with a single tool, in a single pass, to create the single, larger radius. This saves considerable time and expense, and the scroll wall is stronger throughout its length. The concave corner radius matches the convex side radius of the seal. Consequently, the radiused sides of the seal can face the scroll wall transition corner at all points, without interference, and avoiding metal to metal contact. The greater width of the seal also provides more seal surface contact area.

BRIEF DESCRIPTION OF THE DRAWINGS

These and other features of the invention will appear from the following written description, and from the drawings, in which.

DESCRIPTION OF THE PREFERRED EMBODIMENT

Figure 3:
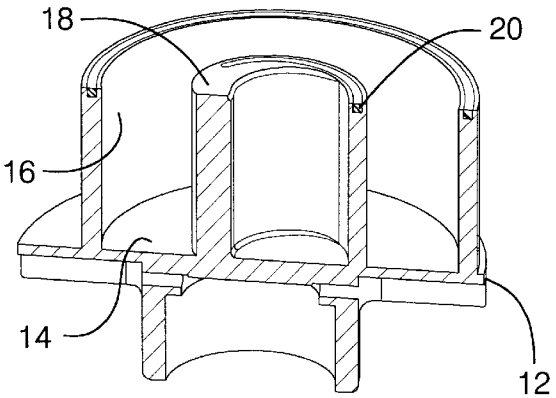
PRIOR ART FIG. 3
FIG. 3 is a cross section through FIG. 1.
Figure 2:
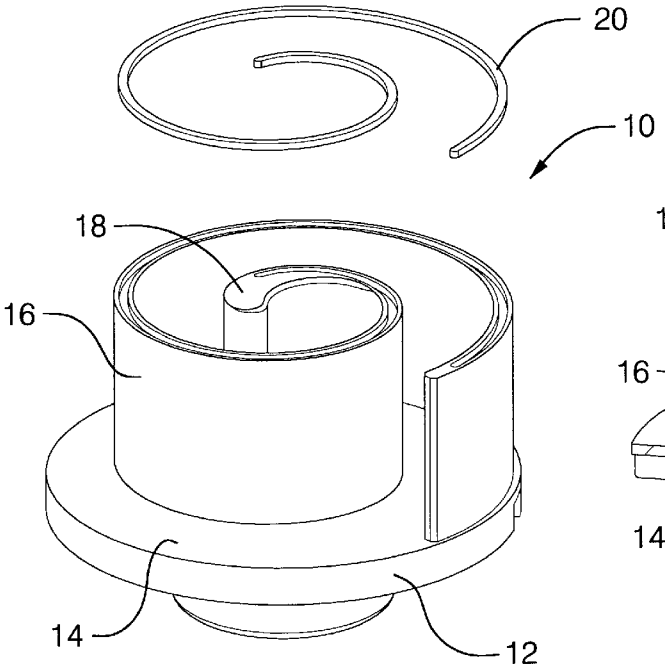
PRIOR ART FIG. 2
FIG. 2 shows the same scroll as in FIG. 1, with the seal disassembled.
Figure 1:
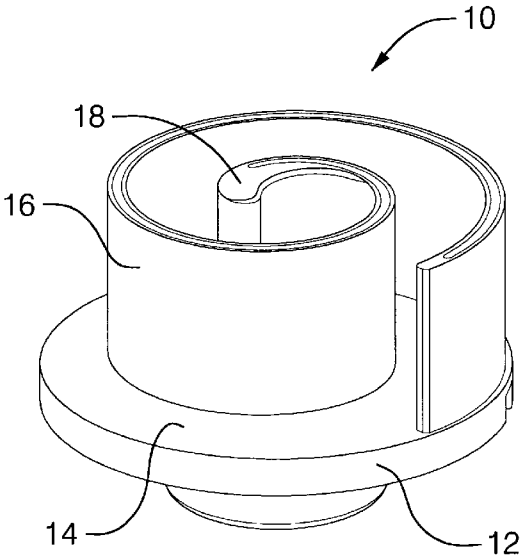
PRIOR ART FIG. 1
FIG. 1 is a prior art scroll and tip seal.
Figure 4:
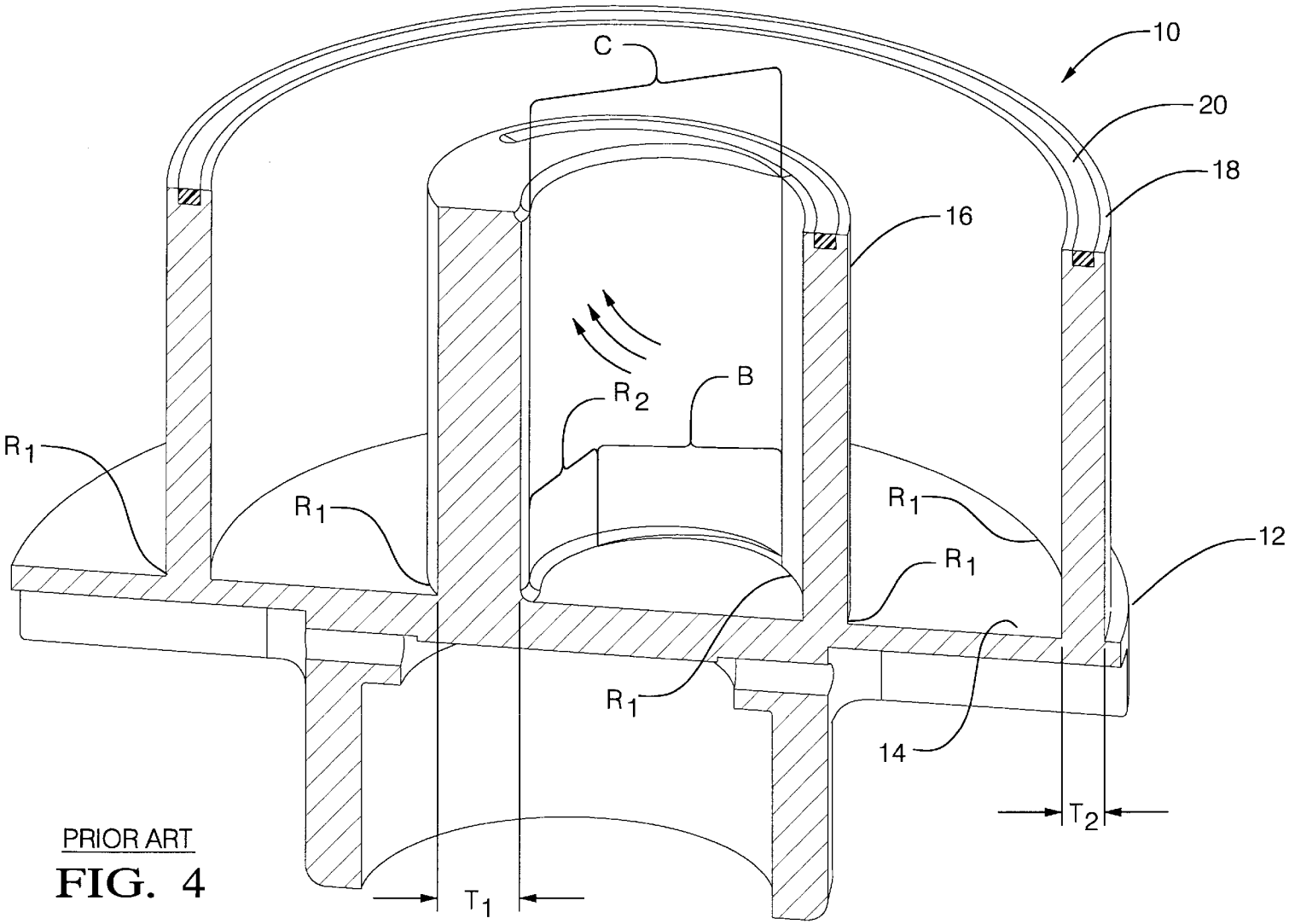
PRIOR ART FIG. 4
FIG. 4 is an enlargement of FIG. 4.
Figures 5, 6, 7:
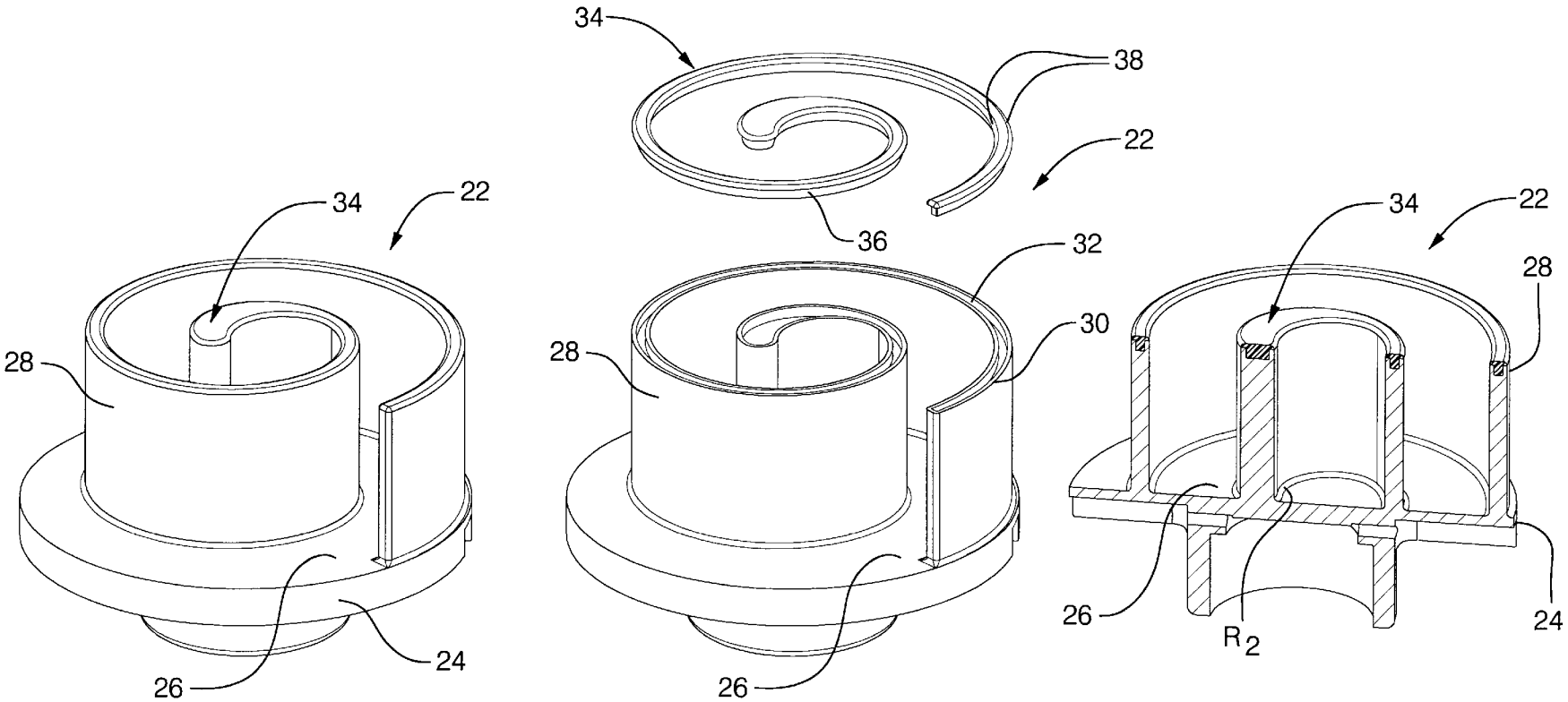
FIG. 5 is a preferred embodiment of a scroll and improved tip seal according to the invention.
FIG. 6 shows the same scroll as in FIG. 5, with the tip seal disassembled.
FIG. 7 is a cross section through FIG. 5.
Figure 8:
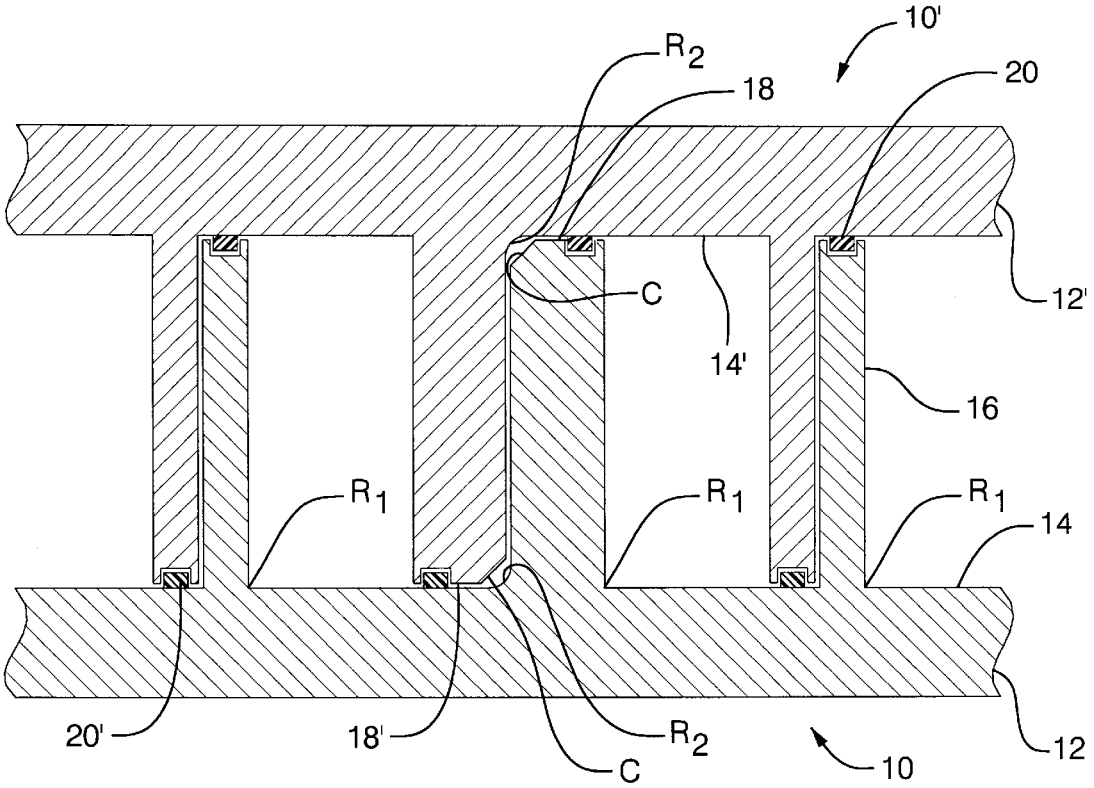
PRIOR ART FIG. 8
FIG. 8 is a cross section through a pair of interfitted scrolls incorporating a conventional seal.

Referring first to FIGS. 5 and 6, an orbital scroll and seal according to the invention is indicated generally at 22. A fixed scroll, non illustrated, would have an identical shape and surfaces as to all aspects relevant to the invention. Scroll 22 has a base plate 24 with flat sealing surface 26 and a spiral scroll wall 28 extending perpendicularly therefrom to terminal edge 30. A seal mounting groove 32 is machined into edge 30, almost end to end, leaving a substantially constant width, thin border of residual surface area. Seal 34 is injection molded of conventional seal plastic material, with a width that generally matches the width of edge 30 at all points, rather than being narrower at all points. More specifically, seal 34 has a lower base 36 that substantially matches the shape of the groove 32 into which it is inserted, although with a very slightly smaller width and depth. This would be similar to the relative size relationship between conventional tip seals and mounting grooves, as described above. Above the base 36, the upper portion of seal 34 extends out flush to the corners edge 18, with a pair of convex radiused sides 38. Between the convex sides 38, the seal 34 is basically flat. The radiused sides 38 are matched to other structure described next.

Referring next to FIG. 7, scroll 22 differs from prior art scroll 10 in one simple, but very significant aspect. The concave corner transition from the flank of scroll wall 28 integrally into the flat sealing surface has a single radius, all the way around and on both sides, that is substantially equal to the larger radius R2 noted above, or approximately 1 mm. This means that scroll 22 can be much more simply manufactured. In essence, once the larger R2 radius is cut all the way round, the process stops. No secondary and tertiary operations to cut the smaller radius R1 out of R2, or to add the chamfer C, are needed. In addition, the new seal 34 is molded in one step, just as old seal 20 would be, so the overall manufacturing process is simplified, modified only by the elimination of process steps and tools, and the addition of none.

Figure 9:
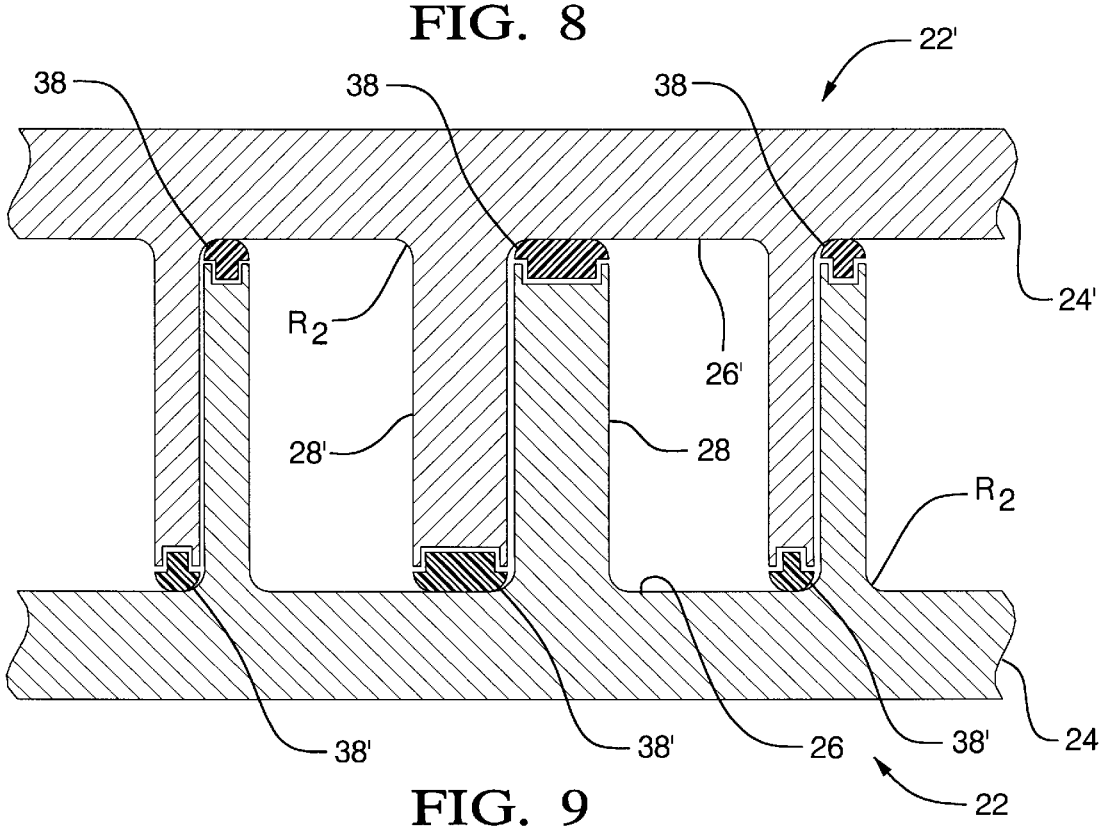
FIG. 9 is a cross section through a pair of interfitted scrolls incorporating an embodiment of a seal according to the invention.

Referring next to FIG. 9, the operation of an assembled pair of scrolls 22 and 22' is illustrated. When scroll 22 and an opposed scroll 22' with the same shape and same seal 34' are interengaged in conventional fashion, the concave corner transition with the larger, single radius R2 faces the corresponding, equally radiused sides 38 (38') of seals 34 (34'), at all points along the length of each. There is no convex corner to concave corner interference, and no potential for the metal to metal contact, as is inherent with the narrower seal 20. The full width seal 34 covers and insulates the entire upper surface area of the edge 30, in effect. The flat top surfaces of the seals 34 (34') engage the opposed flat sealing surfaces 26' (26). The seal bases 36 (36') are lifted slightly out of the mounting grooves 32 (32') just as the conventional seals 20 do, and the flat surfaces thereof are gas pressure biased into the scroll base surfaces 26 in similar fashion to seal 20. The sealing achieved is as good or better than seal 20, since the seal surface area in contact is actually larger. Moreover, the seal surface area is greater at the inboard ends of the scroll walls 28 (28') at exactly the location where the gas pocket pressure is greatest. The scroll wall 28 is strong enough near the inboard end to resist the greater gas pressure, given the sufficiently large radius R2, and the fact that the larger R2 radius extends all the way around presents no problem, as excessive scroll wall strength is no drawback. The primary advantage, however, is clearly the simplified manufacture of the scroll that is made possible by the novel seal configuration.

Variations in the embodiment disclosed could be made. Theoretically, the seal 34 could be joined to the scroll wall edge 30 in some other way, such as reversing the groove 32 and the base 36. This would be possible, since the seal 34 is full width, but would not be possible with a conventional, narrower seal. The seal base 36 and corresponding mounting groove 32 could be given a constant width, similar to the constant width of the conventional seal 20, while the upper portion of the seal 34 remained the same shape and size. A single pass with a cutting tool would be able to cut a such a constant width mounting groove, whereas the non constant width groove 32 shown would require multiple passes near the inboard end of the edge 3 to provide the extra width. This is not difficult, and would still use the same, single cutting tool, but would require more time than a single cutting tool pass. The border of residual surface area of edge 30 that surrounded such a constant width mounting groove would not be a constant width, however, as disclosed in the preferred embodiment. There may be an advantage to having the groove 32 be wider near the inboard end, as shown, as it provides a more secure mounting of the seal 34 in exactly that area where the gas pocket pressure is the greatest. It will be understood, therefore, that it is not intended to limit the invention to just the embodiment shown.

What is claimed is:

1. A scroll and tip seal comprising in combination;

a scroll base plate having a flat sealing surface and a scroll wall extending perpendicularly upwardly therefrom to a terminal edge, with a concave corner transition between said scroll wall and flat sealing surface having a single radius substantially all the way around, and, a tip seal joined to the terminal edge of said scroll wall and covering substantially the entire width thereof, said tip seal having convex sides that comprise a convex radius substantially equal to the single radius of said scroll concave corner transition, whereby, when said scroll and tip seal are interengaged with an opposed scroll and tip seal of the same size and shape, the two seals engage the flat sealing surfaces of the opposed scroll with the convex radiused sides of the tip seals facing the concave corner transitions of the opposed scroll, thereby avoiding contact and interference.

2. A scroll and tip seal comprising in combination;

a scroll base plate having a flat sealing surface and a scroll wall extending perpendicularly upwardly therefrom to a terminal edge having a seal base mounting groove, with a concave corner transition between said scroll wall and flat sealing surface having a single radius substantially all the way around, and, a tip seal having a base inserted into said mounting groove and an upper portion covering substantially the entire width of said scroll wall terminal edge, said tip seal upper portion comprising convex sides having a radius substantially equal to the single radius of said scroll concave corner transition, whereby, when said scroll and tip seal are interengaged with an opposed scroll and tip seal of the same size and shape, the two seals engage the flat sealing surfaces of the opposed scroll with the convex radiused sides of the tip seals facing the concave corner transitions of the opposed scroll, thereby avoiding contact and interference.

3. A scroll and tip seal comprising in combination;

a scroll base plate having a flat sealing surface and a scroll wall extending perpendicularly upwardly therefrom to a terminal edge having a seal base mounting groove cut into said edge so as to leave a constant width border of residual terminal edge surface, with a concave corner transition between said scroll wall and flat sealing surface having a single radius substantially all the way around, and, a tip seal having a base inserted into said mounting groove and an upper portion covering substantially the entire width and length of said scroll wall terminal edge, said tip seal upper portion comprising convex sides having a radius substantially equal to the single radius of said scroll concave corner transition, whereby, when said scroll and tip seal are interengaged with an opposed scroll and tip seal of the same size and shape, the two seals engage the flat sealing surfaces of the opposed scroll with the convex radiused sides of the tip seals facing the concave corner transitions of the opposed scroll, thereby avoiding contact and interference.

* * * * *